United States Patent [19]

Olson

[11] Patent Number: 4,802,856

[45] Date of Patent: Feb. 7, 1989

[54] APPARATUS FOR TRAINING SKIERS

[76] Inventor: Bruce R. Olson, 458 S. Clovis Ave., #105, Fresno, Calif. 93727

[21] Appl. No.: 112,620

[22] Filed: Oct. 26, 1987

[51] Int. Cl.[4] ..... A63B 69/18

[52] U.S. Cl. ..... 434/253; 272/97

[58] Field of Search ..... 434/253; 272/97

[56] References Cited

U.S. PATENT DOCUMENTS

| | | | |
|---|---|---|---|
| 320,462 | 6/1885 | Cowing | 434/254 |
| 1,866,047 | 7/1932 | Lucas | 272/85 |
| 3,462,141 | 8/1969 | Robbins | 272/97 |
| 3,475,021 | 10/1969 | Ruegsegger | 434/253 |
| 3,511,499 | 5/1970 | Schwalder | 272/97 |
| 3,591,172 | 7/1971 | Hude | 272/97 |
| 3,874,656 | 4/1975 | Wintersteller | 272/97 |
| 4,342,453 | 8/1982 | Wagner | 434/253 X |
| 4,396,189 | 8/1983 | Jenkins | 434/253 |
| 4,744,557 | 5/1988 | Smirmaul | 434/253 X |

FOREIGN PATENT DOCUMENTS

| | | | |
|---|---|---|---|
| 24710 | 6/1906 | Austria . | |
| 2358117 | 11/1973 | Fed. Rep. of Germany | 272/97 |
| 554951 | 6/1923 | France . | |

*Primary Examiner*—Ira S. Lazarus
*Assistant Examiner*—Peggy Neils
*Attorney, Agent, or Firm*—Worrel & Worrel

[57] ABSTRACT

Apparatus for training skiers the apparatus including a frame mounting a pair of resilient cords which interconnect the frame and the tails of the individual skis for supporting the tails of skis in elevated relation and pivot assemblies mounted on the tips of skis and rested on a supporting surface and operable to allow a skier wearing the skis to swing the skis and pivot the skis about their respective longitudinal axes for purposes of simulating various ski maneuvers.

6 Claims, 3 Drawing Sheets

APPARATUS FOR TRAINING SKIERS

BACKGROUND OF THE INVENTION

1. Field of the Invention

The present invention relates to an apparatus for training skiers for downhill skiing and more particularly to such an apparatus which is operable to mount a pair of skis in spaced angulated rested relation on the surface of the earth, the apparatus operable to allow independent movement of the skis about their respective longitudinal axes for the purpose of permitting the skier to simulate various ski turns and thereby helping the skier to develop the correct sense of timing through repetition of the various body positions and ski shifts necessary to perform same.

2. Description of the Prior Art

Among the outdoor sports most enjoyed in winter, snow skiing is the sport most popular with winter enthusiasts. With the advent of improved instruction techniques and the development of new, lighter, and improved equipment, this arduous sport, once the province of only quite athletic individuals, is now enjoyed by people of all levels of athletic ability.

The inability of a skier to control his skis in various situations can lead to spills and possible serious injury. Manufacturers of skis have approached the various problems associated with ski control by directing a great deal of research activity toward improving the materials utilized in the manufacture of these skis. Such activities have been directed to, for example, manufacturing skis that have "soft tips" and "hard tails" or conversely "hard tips" and "soft tails" to give the ski varied performance characteristics in diverse snow conditions. In addition, the skis have been manufactured with various edge configurations which are better able to engage the snow surface and give the manifestation of enhanced control.

Although there have been significant advances in producing skis for recreational and competitive use which give the individual skier improved control, skiers of all levels of ability have sought after an apparatus which would permit them further to refine or otherwise develop an improved skiing technique. It should be understood that skiing is a sport which requires a developed sense of timing, balance, and rhythm, especially to perform the expert short swing parallel turns associated with an accomplished recreational skier. To develop this sense of balance and timing, the skier must coordinate assorted muscle groups which perform the weighting of the uphill and downhill skis; the performance of ski edging; pole planting; and the absorption of shock from terrain changes which the skier is traveling over.

Although there have been significant advances in producing training devices for recreational and competitive skiers which gives the individual skier a means by which they can improve their skiing technique in the off season, the improvements in these devices have been only marginally satisfactory. For example, many of the prior art devices do not permit the rotation of the skis about their longitudinal axes. This is an important feature inasmuch as this motion is necessary to permit the effective edging of the skis. Furthermore, the prior art devices generally do not permit skiers to utilize their own equipment thereby permitting the skiers to become familiar with the use and "feel" of their equipment.

Another common shortcoming in the prior art devices stems from characteristics inherent in their design inasmuch as the prior art devices are generally incapable of accurately reproducing an actual ski turn thereby permitting the skier to improve their ski technique by allowing the skier to develop the correct sense of timing, balance and rhythm with respect to the turn in question. As a consequence, skiers of all levels of ability have continued to seek after an apparatus for training downhill skiing which permits the skier to pattern actual ski turns with accuracy sufficient to allow the user thereof to improve his actual ski technique and thereby selectively choose the speed and control which he wishes to maintain whether the speed is relatively low or of competitive caliber.

Therefore, it has long been known that it would be desirable to have an improved apparatus for training skiers which is particularly well suited to allow the skier accurately to pattern and coordinate the body positions and ski shifts necessary to perform assorted ski turns in a repetitive and highly accurate fashion, which is relatively inexpensive to manufacture and maintain, and which is characterized by ease of utilization.

SUMMARY OF THE INVENTION

Therefore, it is an object of the present invention to provide an improved apparatus for training skiers.

Another object is to provide such an apparatus which can be utilized by skiers of all levels of abilities.

Another object is to provide such an apparatus which permits the skier cyclically to swing and rotate a pair of skis independently about their respective longitudinal axes to simulate the basic actions of unweighting and edging the individual skis which is necessary for most types of ski turns.

Another object is to provide such an apparatus which permits the repetition of simulated ski turns utilizing the skier's own equipment, the apparatus helping the skier to develop the correct sense of timing, rhythm, and balance through repetition, of the various body movements and ski shifts necessary to accomplish same.

Another object is to provide such an apparatus which produces a natural frequency of motion in the ski tails which approximates the rate of turning necessary to maintain effective control on an advanced to intermediate ski slope.

Another object is to provide such an apparatus wherein the skier utilizing same employs the muscle groups which are primarily involved in skiing, and the physical exertion necessary to utilize the apparatus improves the skier's overall aerobic conditioning.

Another object is to provide such an apparatus which is particularly well suited for training a skier to make precise turns and otherwise have effective control over a wide variety of snow conditions and snow topography.

Another object is to provide such an apparatus which is characterized by simplicity of design, ease of employment and can be manufactured and sold at a relatively nominal cost.

Further objects and advantages are to provide improved elements and arrangements thereof in an apparatus for the purposes described which is dependable, economical, durable and fully effective in accomplishing its intended purposes.

These and other objects and advantages are achieved in an apparatus for training skiers, the apparatus having a frame resting on the surface of the earth and mounting a pair of skis which are disposed in angulated, spaced, rested relation on the surface of the earth, the frame supporting the pair of skis for independent movement about their respective longitudinal axes, and a pair of elastic cords are connected between the frame and the tails of each ski for supporting the tail of each ski in spaced relation to the surface of the earth, the apparatus permitting the skier cyclically to swing and rotate each ski about its respective longitudinal axis for the purpose of emulating various ski turns.

DESCRIPTION OF THE PREFERRED EMBODIMENT

Figure 1:
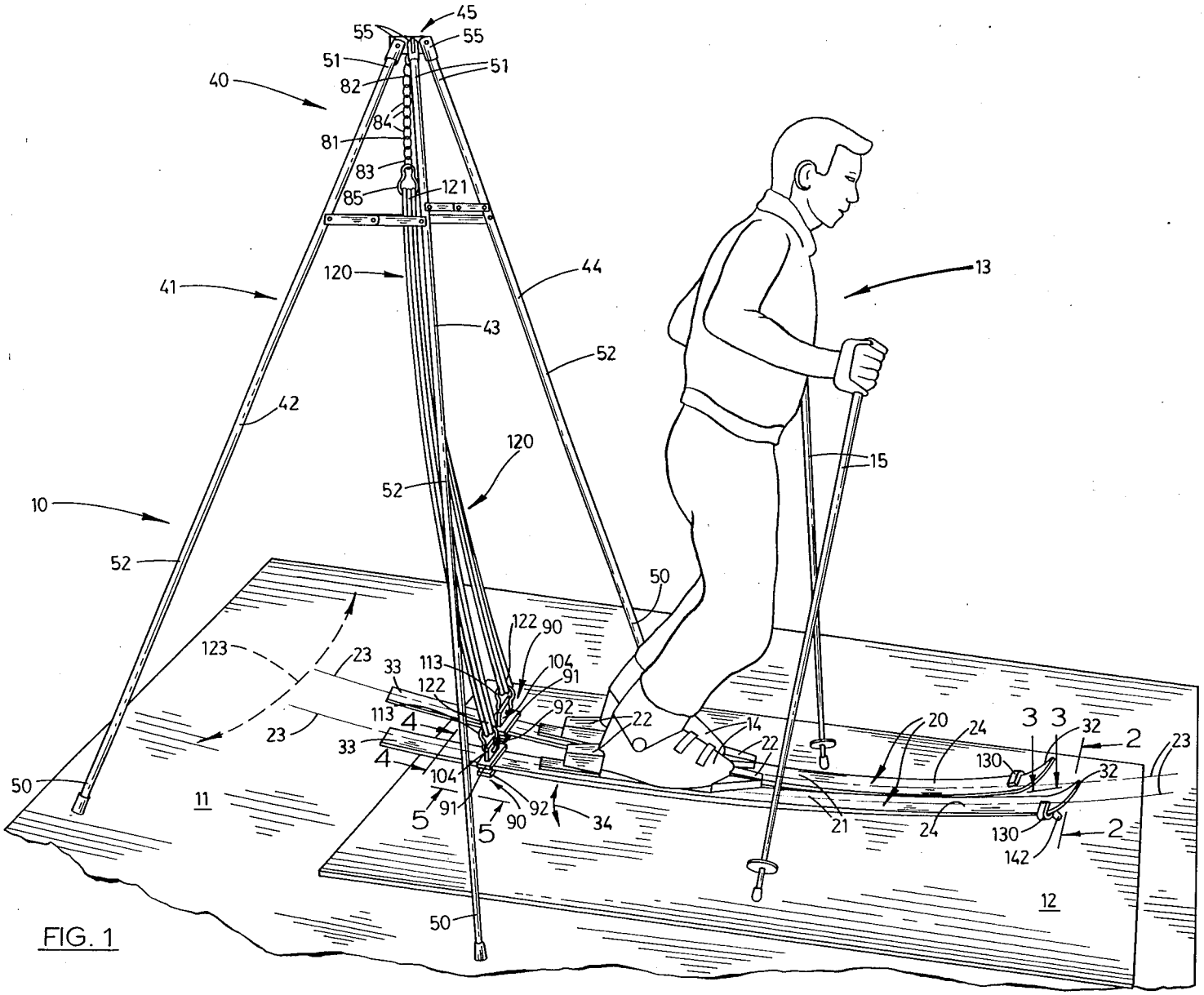
FIG. 1 is a perspective view of the apparatus of the subject invention shown in a typical operative environment.

Referring more particularly to the drawings, the apparatus for training skiers embodying the principles of the present invention is generally indicated by the numeral 10 in FIG. 1.

Figure 2:
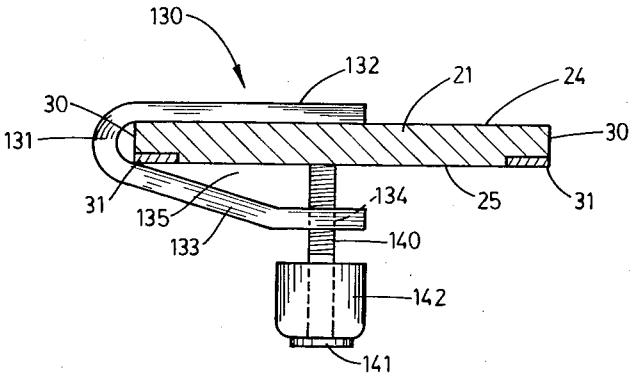
FIG. 2 is a somewhat enlarged, transverse, vertical section taken from a position indicated by line 2—2 of FIG. 1.
Figure 3:
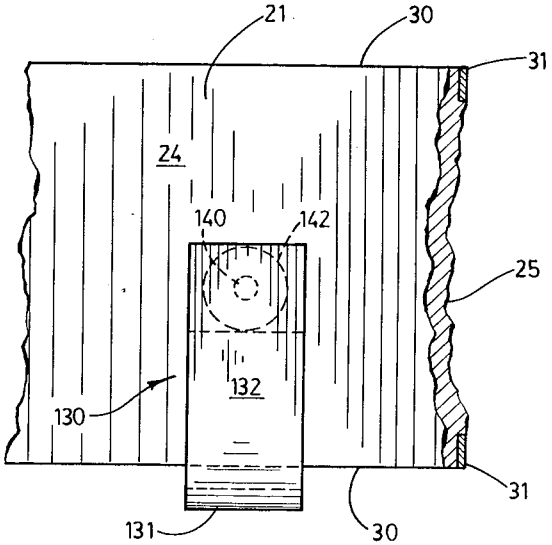
FIG. 3 is a somewhat enlarged, fragmentary plan view of the apparatus of the subject invention taken from a position indicated by line 3—3 of FIG. 1.

For illustrative convenience, the apparatus 10 as shown and described herein is depicted in a typical operative environment where it is placed on a supporting surface such as the surface of the earth 11, and disposed in partial overlaying relation with respect to a pad generally indicated by the numeral 12. The pad can be of any suitable wear resistant material such as indoor-/outdoor carpeting or the like. The pad is operable to permit the user thereof to employ the apparatus on any indoor or outdoor surface, the pad adapted to protect the bottom of each ski and the underlying supporting surface from damage. The skier, which is generally indicated by the numeral 13, wears a pair of ski boots 14 and holds a ski pole 15 in each hand. Each ski boot is releasably affixed to a ski 20. Each ski is of traditional design having a main body 21 which mounts a binding 22 which engages the ski boot. Each ski further has a longitudinal axis generally indicated by the line labeled 23, a top surface 24, a bottom surface 25, and a peripheral edge, generally indicated by the numeral 30. As seen most clearly by reference to FIGS. 2 and 4, the peripheral edge mounts a sharpened edge 31 which is operable to engage the snow surface, not shown, the edge causing each ski to turn. Each ski further has a forward portion or tip 32 and a rearward portion or tail 33. As best seen by reference to FIG. 1, the apparatus 10 is adapted to mount each ski in angulated, spaced, resting relation on the surface of the earth. More particularly, a space 34 is formed between the bottom surface 25, which is located at the tail 33 of each ski and the surface of the earth 11, the space 34 permitting each ski to be moved longitudinally, horizontally, vertically and rotationally about their respective longitudinal axis 23 thereby enabling the skier to simulate assorted ski turns in a highly accurate and repetitive fashion.

Figure 6:
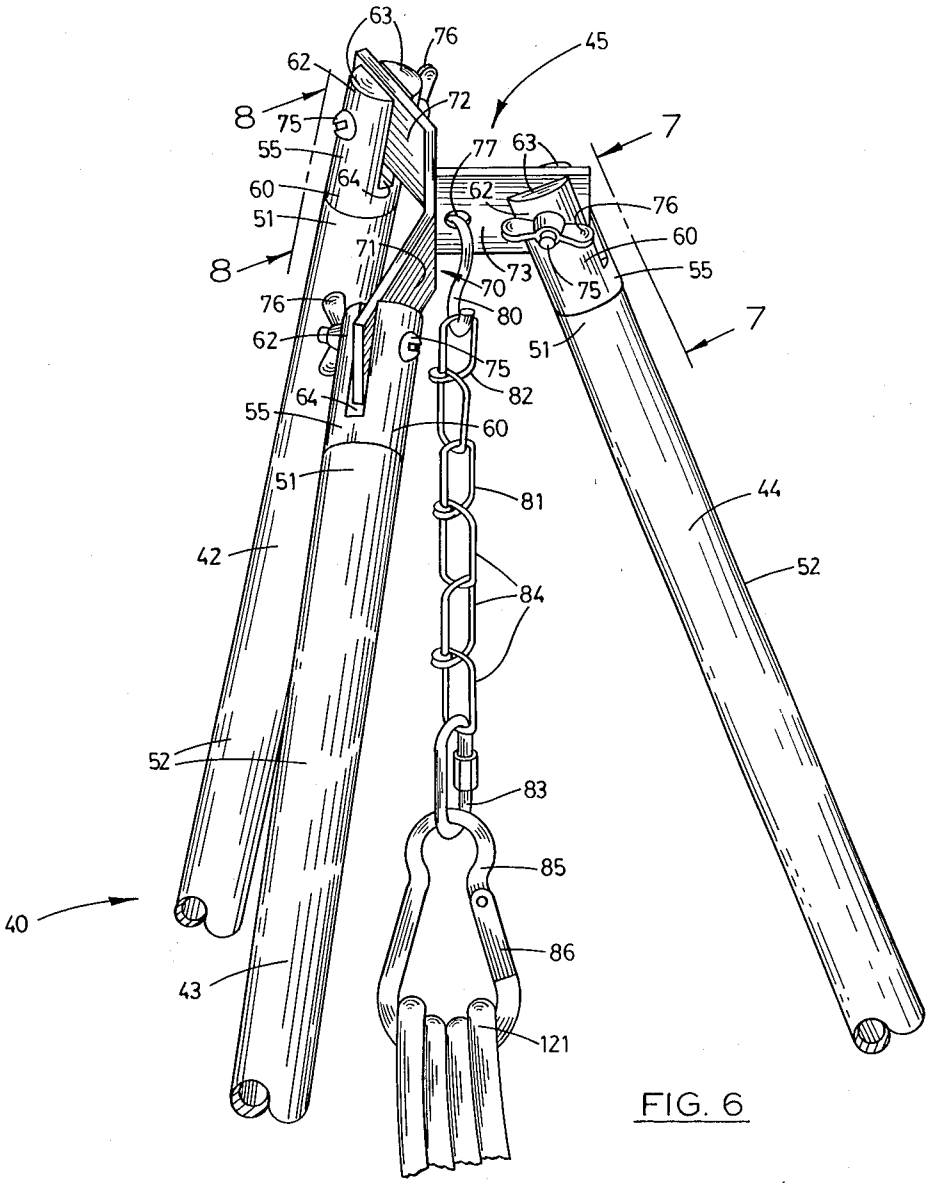
FIG. 6 is a somewhat enlarged, fragmentary, perspective view of the apparatus of the subject invention.
Figure 7:
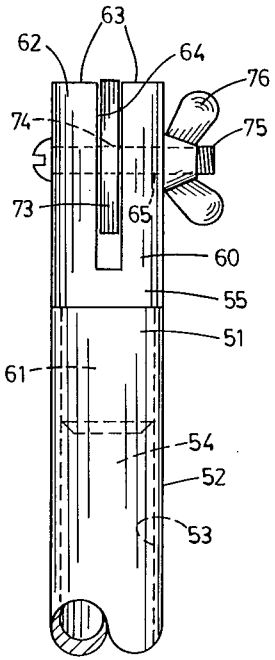
FIG. 7 is a somewhat enlarged, fragmentary, side elevation of the apparatus of the subject invention taken from a position indicated by line 7—7 of FIG. 6 and showing some underlying structure thereof in phantom lines.
Figure 8:
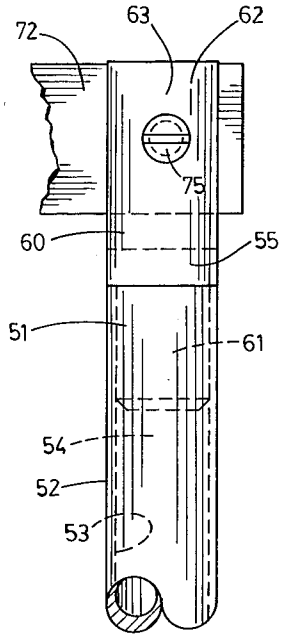
FIG. 8 is a somewhat enlarged, fragmentary, side elevation of the apparatus of the subject invention taken from a position indicated by line 8—8 of FIG. 6 and showing some underlying structure thereof in phantom lines.

A frame, which is generally indicated by the numeral 40, is adapted to support each ski 20 for independent movement about its respective longitudinal axis 23. The frame, which is further operable to support each ski in angulated spaced rested relation on the surface of the earth 11, consists of a tripod 41, which has a first, second and third pole, each of which is indicated by the numeral 44. The tripod, which was selected for its exceptional stability, has an apex 45. As best seen by reference to FIG. 1, each pole has a proximal or earth engagement end 50, a distal end 51, an exterior surface 52, and an interior surface 53. The interior surface 53 defines a channel 54 which is operable, at the distal end 51 thereof, slidably to receive a mounting plug 55. The mounting plug, which is manufactured typically out of fiberglass, or other high impact plastic material, has a main body 60 with a first portion 61 which is formed into a substantially cylindrical shape. The first portion 61 is conformably dimensioned slidably to be received in the channel 54 defined by the interior surface 53. The main body 60 further has a second portion 62 which defines a pair of legs 63, the legs further circumscribing a channel 64. As best seen by reference to FIGS. 6 and 7, a bolt receiving station 65 is formed in each leg 63.

An angulated substantially Y-shaped bracket 70 is mounted at the apex 45 and disposed in slidable mating receipt with each of the channels 64 formed in the individual mounting plugs 55. The bracket 70 has a first, second and third arm 71, 72, and 73, respectively. Each arm has an orifice 74 formed therein which, when received in the channel 64, is disposed in registry, and in substantially coaxial alignment with, the bolt receiving station 65 which is formed in the pair of legs 63. A bolt 75 is slidably received in the bolt receiving station 65 and a wing nut 76 is affixed thereto, the bolt and wing nut are operable to secure the angulated bracket 70 on the distal end 51 of each pole 42, 43 and 44, respectively. As best seen by reference to FIG. 6, an orifice 77 is formed in the third arm 73, and is adapted relasably to mount an S-shaped hook 80. The S-shaped hook further mounts a chain 81 having first and second ends 82 and 83, respectively. As best seen by reference to FIG. 6, the chain has a plurality of links 84 which can be engaged by the S-shaped hook. This permits the chain to be adjusted such that it can depend downwardly at varying lengths from the apex 45. The second end 83 of the chain 81 further mounts a snap link 85 which possesses a spring-loaded gate 86.

Figure 4:
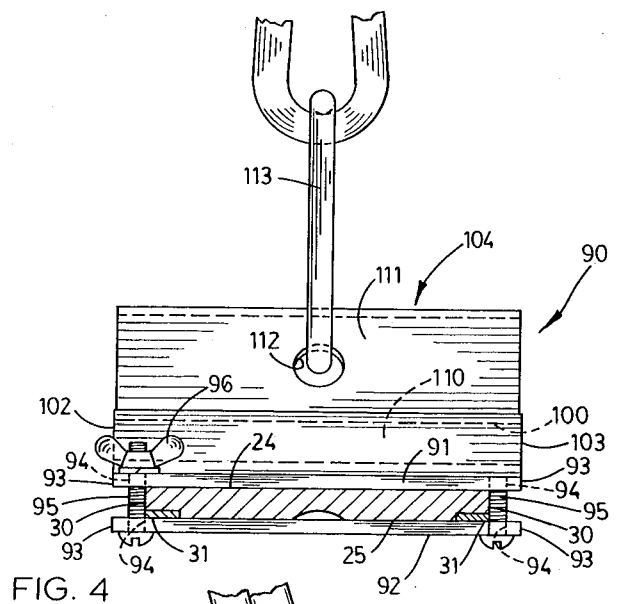
FIG. 4 is a somewhat enlarged, fragmentary, transverse, vertical section taken on line 4—4 of FIG. 1.
Figure 5:
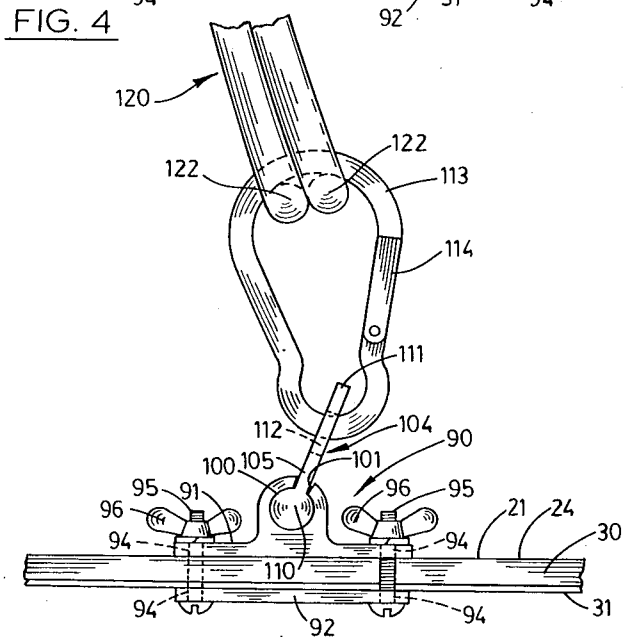
FIG. 5 is a somewhat enlarged, partial, side elevation of the apparatus of the subject invention taken from a position indicated by line 5—5 of FIG. 1.

As best seen by reference to FIGS. 4 and 5, a support frame, which is generally indicated by the numeral 90, is mounted in close proximity to the tail 33 of each ski 20. The support frame includes a top plate 91 and a bottom plate 92. Each plate 91 and 92 has a peripheral edge 93, which individually extends beyond the peripheral edge 30 of each ski. Formed into the peripheral edge of the top and bottom plate 91 and 92, respectively, is a pair of bolt receiving stations 94. The bolt receiving stations formed in the top and bottom plates are disposed in opposite corners as best seen by reference to FIG. 4. The pair of bolt receiving stations further are substantially coaxially aligned, oee with the other, thereby permitting a pair of bolts 95 to be individually received in slidable mating relation therein. Wing nuts 96 are affixed to the bolts 95 and operate securely to clamp the top and bottom plates to the main body 21 of each ski 20.

As best seen by reference to FIG. 5, the top plate 91 mounts a discontinuous channel or housing 100 which is disposed substantially transversely of the longitudinal axis 23 of each ski 20. The channel 100 defines a gap or space 101, and further has a first end 102 and a second end 103. As should be understood, the first and second ends of the channel 100 are open; the channel adapted to receive a slide plate which is generally indicated by the numeral 104. The slide plate has a main body 105 which mounts a cylindrically shaped first portion 110. The first portion 110 is conformably dimensioned to be slidably received in the channel 100. The main body further has a second portion or plate 111 which is affixed to the first portion by welding or the like. The plate 111 has a thickness dimension which permits it to be slidably received in the gap 101. As illustrated most clearly by reference to FIG. 4, an orifice 112 is formed in the plate 111 and is operable to be engaged by a snap link 113 of conventional design. The snap link 113 has a spring loaded gate 114.

As best seen by reference to FIG. 1, two pairs of resilient cords 120 are releasably engaged by the snap link 85 and depend downwardly therefrom. Each resilient cord has a first end 121 and a second end 122. The first end of each resilient cord is affixed to the snap link 85 which is mounted to the second end 83 of the chain 81. The second end of each resilient cord is releasably affixed to the snap link 113 which is mounted to the orifice 112 of each slide plate 104. The overall length and cross-sectional dimension of each resilient cord is such that each pair of resilient cords, acting in combination, imparts a frequency of motion to each ski tail 33 which closely approximates the rate of turning necessary to maintain effective control on an advanced to intermediate ski slope, not shown. As best imagined by a study of FIG. 1, each pair of resilient cords allows the individual ski tails to move independently of each other within a zone of travel, generally indicated by the numeral 123; each ski 20 being permitted to move horizontally, vertically and rotationally about its respective longitudinal axis 23, thereby permitting the skier 13 to simulate various ski turns on a repetitive basis in order to develop a correct sense of timing, balance and rhythm.

A pair of pivot assemblies or forward supports 130 are individually mounted in close proximity to the tip 30 of each ski 20. Each pivot assembly 130 has a unitary main body 131 which includes a top portion 132 and a bottom portion 133. A threaded orifice 134 is formed in the bottom portion 133, and the top and bottom portions define a channel 135 which is adapted to receive the main body 21 of each ski 20. As best seen by reference to FIG. 2, a threaded post 140 is screwthreadably received in the threaded orifice 134, the threaded post further has a head 141. A grip 142 is affixed to the head 141 and is operable to impart rotational movement to the threaded post so as to capture the main body 21 of each ski 20 in the channel 135 formed between the top and bottom portions 132 and 133, respectively. As best seen by reference to FIG. 2, the threaded post is disposed substantially centrally of the bottom surface 25 and in substantial alignment with the longitudinal axis 23 of each ski 20. As best imagined by a study of FIG. 1, as the tail 33, of each ski, is cyclically swung and rotated in the zone of travel 123, the individual pivot assemblies 130 permit the main body 21 of each ski to be shifted such that a skier can simulate the body and ski positions necessary to effectuate the edging which will accomplish the desired ski turn. By adjusting the length of the chain 81 the skier's body weight can be approximately balanced by the elastic tension of the two pairs of resilient cords 120.

OPERATION

The operation of the described embodiment of the present invention is believed to be readily apparent and is briefly summarized at this point.

Each ski 20 is worn by a skier 13 in the conventional manner, that is, the skier wears a pair of ski boots 14 that are releasably engaged by the ski bindings 22 which are mounted on each ski.

As best seen by reference to FIG. 1, each support frame 90 is individually mounted in close proximity to the tail or rearward portion 33 of each ski 20. Each support frame is interconnected to the frame 40 by a pair of resilient cords 120 which are operable to suspend each ski in angulated, spaced, rested relation on the surface of the earth 11 thereby permitting the tails of each ski to be moved variously in the zone of travel 123 such that the skier can simulate various ski turns. As earlier discussed, the lengths and cross-sectional dimensions of each pair of resilient cords 120 is selected such that each pair of resilient cords will impart a natural frequency of motion to the individual ski tails which closely simulates a selected ski turn on an advanced to intermediate ski slope. Similarly, it should be understood that the cyclical swinging and rotation of each ski 20 about its respective longitudinal axis 23 permits the skier 13 closely to approximate the basic body actions of weighting and unweighting each ski and the edging actions necessary to perform most types of ski maneuvers. The apparatus 10 allows the repetition of these ski turns thereby permitting the development of improved rhythm, balance, timing, and the aerobic conditioning required to improve the overall ski technique. In the event the skier becomes unbalanced and falls off the skis 20, the slide plate 104 is operable to disengage from the support frame 90 by sliding out of mating engagement with the channel 100. The pivot assemblies 130 are further operable to permit the main body of each ski to rotate about its longitudinal axis for purposes of permitting the accurate reproduction of a simulated ski turn.

Therefore, the apparatus for training skiers for downhill skiing of the present invention provides a new and novel means by which a skier can practice simulated ski turns for purposes of improving their overall skiing technique. The invention is operable to exercise the various muscle groups which are primarily involved in performing various ski turns and is adapted to improve the skiers' overall performance by permitting the skiers to utilize their own equipment. Furthermore, the apparatus allows the skier to develop a correct sense of balance, rhythm and timing through repetition of the various turns. Finally, the repeated use of the apparatus improves the skier's aerobic conditioning which is necessary for extended ski runs.

Although the invention has been herein shown and described in what is conceived to be the most practical and preferred embodiment, it is recognized that departures may be made therefrom within the scope of the invention which is not to be limited to the illustrative details disclosed.

Having described my invention, what I claim as new and desire to secure by Letters Patent is:

1. Apparatus for training a skier wearing a pair of skis, the apparatus comprising:

a tripod adapted to be rested on a supporting surface in upright relation, the tripod further having an apex;

a chain releasably mounted on the tripod adjacent to the apex, the chain adjustable as to length relative to the apex;

a support frame mounted on the rearward portion of each ski and having a channel substantially cylindrically shaped in cross section disposed substantially transversely of the longitudinal axis of each ski, and a plate having a portion slidably received in the channel;

a pair of resilient cords having opposite ends individually interconnecting the rearward portion of each ski with the chain, each resilient cord mounted at one end on one of the plates and mounted at the opposite end on the chain, the resilient cords individually operable to position the rearward portion of each ski in an elevated position with respect to the supporting surface; and a forward support assembly mounted on the forward portion of each ski and disposed in rested relation on the supporting surface in supporting relation to said forward portion of each ski, the forward support assembly permitting substantially independent pivotal movement of the respective skis substantially about their respective longitudinal axes to permit the skier wearing said skis to simulate skiing maneuvers, and the plate operable to release the rearward portions of the skis from said elevated positions upon rotation of the skis sufficiently about their respective longitudinal axes to cause said portions of the plates to slide from said channels.

2. The apparatus of claim 1 wherein each forward support assembly has a main body slidably mounted on the forward portion of each ski and a post is screwthreadably mounted on the main body of each forward support assembly in engagement with its respective ski to clamp the main body of the forward support assembly on the forward portion of the ski, said post disposed for rested engagement with said supporting surface to allow pivoting of each ski about its respective longitudinal axis.

3. Apparatus for training skiers for downhill skiing and adapted for use with a pair of skis, each ski having a tip, a tail, a longitudinal axis and a main body, the apparatus comprising:

a tripod adapted to be disposed in rested relation on a supporting surface and a chain is releasably mounted on the tripod and adapted for adjustment as to length relative to the tripod;

a support frame releasably mounted on the tail of each ski, each support frame further having a discontinuous channel disposed substantially transversely of the longitudinal axis of each ski, and a slide plate having an orifice is slidably mounted in each channel, the slide plates operable to release the skis from the apparatus upon rotation of the skis sufficiently about their respective longitudinal axes to cause the plates to slide from said channels;

a pair of resilient cords having opposite ends, the pair of resilient cords attached at one end to the orifice and attached at the other end to the chain, each pair of resilient cords mounting each tail in spaced relation to the surface of the earth, and the chain operable to adjust the height of the tails of each ski are suspended above the supporting surface; and a forward support is mounted to the tip of each ski, each forward support having a main body which is conformably dimensioned slidably to receive the main body of the ski and a threaded post is screwthreadably mounted on the main body and is adapted to engage the main body of the ski, each threaded post operable to hold the tip of each ski in spaced relation to the supporting surface, the apparatus permitting the skier to move each ski independently along a path of travel and about its respective longitudinal axis for purposes of simulating various ski maneuvers.

4. The apparatus of claim 3 wherein the discontinuous channel defines a gap and the slide plate has a main body with a cylindrical portion and a palte, the cylindrical portion being conformably dimensioned to be slidably received in the channel, and the plate has the orifice formed therein and is mounted to the cylindrical portion and extends through the gap; the slide plate adapted to slide out of engagement with the discontinuous channel thereby releasing the ski from the apparatus when the skis are sufficiently rotated about their respective longitudinal axes to cause said plates to slide from said channels.

5. The apparatus of claim 4 wherein each post is disposed substantially centrally of the main body of each ski and in substantial co-registry with the longitudinal axis of each ski, and each pair of resilient cords have a length and crosssectional dimension which imparts a frequency of motion to the tail of each ski which closely approximates the rate of turning necessary to allow the skier to maintain effective control on an advanced to intermediate ski slope.

6. Apparatus for training a skier wearing a pair of skis which are operable to be utilized in downhill skiing, the apparatus comprising a frame having an apex and which is adapted to be rested on a supporting surface;

a chain releasably mounted on the frame adjacent to the apex and adapted to be adjusted as to length relative to the apex;

a pair of resilient cords having opposite ends mounted at one end on the chain and depending downwardly therefrom;

a support frame mounted on the rearward portion of each ski and having a plate releasably mounted thereto, the resilient cords individually mounted on each plate and thereby supporting the rearward portion of each ski elevated above the supporting surface while a skier is wearing the skis, the plates individually operable to release the rearward portions of said skis from said elevated positions upon rotation of the skis sufficiently about their respective longitudinal axes to cause the members to release therefrom; and a forward support assembly releasably mounted on the forward portion of each ski and disposed in rested relation on the supporting surface and in supporting relation to said forward portion the forward support assembly permitting substantially independent movement of the forward portion of each ski in all directions in the horizontal plane and in substantially pivotal movement about their respective longitudinal axes thereby allowing the skier wearing said skis to simulate skiing maneuvers.

* * * * *

UNITED STATES PATENT AND TRADEMARK OFFICE

CERTIFICATE OF CORRECTION

PATENT NO. : 4,802,856

DATED : February 7, 1989

INVENTOR(S) : Bruce R. Olson

It is certified that error appears in the above-identified patent and that said Letters Patent is hereby corrected as shown below:

Column 4, line 51, delete "relasably" and substitute ---releasably---.

Column 8, line 25, delete "palte" and substitute ---plate---.

Signed and Sealed this

Twenty-fifth Day of July, 1989

*Attest:*

*Attesting Officer*

DONALD J. QUIGG

*Commissioner of Patents and Trademarks*